US006156978A

United States Patent [19]

Peck et al.

[11] Patent Number: 6,156,978

[45] Date of Patent: Dec. 5, 2000

[54] ELECTRICAL FEEDTHROUGH AND ITS PREPARATION

[75] Inventors: Leonard E. Peck; Timothy S. Romano; Tom K. Evans; Gary B. Hughes, all of Goleta; Karl H. Neumann, Santa Barbara, all of Calif.

[73] Assignee: Raytheon Company, Lexington, Mass.

[21] Appl. No.: 08/277,468

[22] Filed: Jul. 20, 1994

[51] Int. Cl.[7] ..... H01B 17/26

[52] U.S. Cl. ..... 174/151; 174/50.61; 174/152 GM; 29/852

[58] Field of Search ..... 174/151, 152 GM, 174/50.61, 50.63; 29/852, 853; 228/124.5, 122.1, 179.1

[56] References Cited

U.S. PATENT DOCUMENTS

| | | | |
|---|---|---|---|
| 3,385,618 | 5/1968 | Hargis . | |
| 3,901,772 | 8/1975 | Guillotin et al. . | |
| 4,174,145 | 11/1979 | Oeschger et al. | 174/152 GM |
| 4,176,901 | 12/1979 | Ishimaru | 174/152 GM |
| 4,217,137 | 8/1980 | Kraska et al. | 174/152 GM |
| 4,461,925 | 7/1984 | Bowsky et al. | 174/152 GM |
| 4,645,931 | 2/1987 | Gordon et al. | 250/332 |
| 5,057,048 | 10/1991 | Feuersanger et al. | 445/44 |
| 5,086,773 | 2/1992 | Ware | 128/419 P |
| 5,087,416 | 2/1992 | Mizuhara | 420/489 |
| 5,198,671 | 3/1993 | Hatch et al. | 250/352 |
| 5,368,220 | 11/1994 | Mizuhara et al. | 228/124.5 |

OTHER PUBLICATIONS

William D. Callister, Jr. Materials Science and Engineering, p. 250, Jan. 1985.

*Primary Examiner*—Kristine Kincaid
*Attorney, Agent, or Firm*—William C. Schubert; Glenn H. Lenzen, Jr.

[57] ABSTRACT

An electrical feedthrough (34) is prepared by furnishing an aluminum oxide feedthrough plate (70) and at least one feedthrough pin (80) having a length greater than the thickness of the feedthrough plate (70). A pin bore (78) is formed through the feedthrough plate (70) for each feedthrough pin (80). Each pin bore (78) has a pin bore (78) size greater than the feedthrough pin (80) size, preferably by an amount no greater than that required to permit the penetration of a brazing metal (88) between the pin bore (78) and the feedthrough pin (80). Each feedthrough pin (80) is inserted into its respective pin bore (78) and brazed into place utilizing a metallic active braze alloy (88) and no glassy seal. The feedthrough plate (70) may be simultaneously brazed to a package structure (22) using active or nonactive brazing.

18 Claims, 2 Drawing Sheets

ELECTRICAL FEEDTHROUGH AND ITS PREPARATION

BACKGROUND OF THE INVENTION

This invention relates to electrical feedthroughs and, more particularly, to a hermetic ceramic electrical feedthrough.

Many types of apparatus utilize an electrical feedthrough across a wall that otherwise separates two environments. The electrical feedthrough permits electrical signals and power to be conducted across the wall, but prevents any movement of mass, such as gas leakage, across the wall. As an example, an infrared sensor is typically contained in a vacuum enclosure. The sensor is cooled to cryogenic temperatures, typically about 77K or less. Output signals are conducted from the sensor to electronic devices located exterior to the vacuum enclosure, without losing the hermetic vacuum seal, via an electrical feedthrough in the wall of the enclosure.

The feedthrough is usually constructed with a plurality of electrical pins supported in an electrically insulating material such as a ceramic or a glass. The insulating material is joined to and contacts the remainder of the wall of the package structure, here the vacuum enclosure. The insulating material isolates the electrical pins from the wall and from each other.

In one common type of feedthrough, a glass is melted into the space between the electrical pin and a bore through a metallic feedthrough plate. The glass acts as the insulator. Glass sealing has the disadvantage that there may be large gradients in thermal expansion coefficients through the structure, even where the pin and the feedthrough plate are made of the same material (e.g., kovar). Temperature changes occurring during processing and service of the feedthrough create thermal stresses that can lead to failure and loss of hermeticity between the pin and the glass. Glass insulator structures typically have low yields for multiple-pin designs.

In another technique, green ceramic material is placed between the metallic pin and the bore in the ceramic feedthrough plate, and the assembly is heated to sinter the ceramic. This approach requires sintering at high temperature, which may be only difficultly compatible with the other fabrication and assembly steps. Moreover, experience has shown that the ceramic-sealed feedthroughs may lose hermeticity when thermally cycled in harsh environments during service.

There is a need for an improved technique for preparing electrical feedthroughs that produces a more robust structure. The present invention fulfills this need, and further provides related advantages.

SUMMARY OF THE INVENTION

The present invention provides an electrical feedthrough that permits a high density of feedthrough pins. The feedthrough is robust and remains hermetic against gas flow and vacuum loss, even after thermal excursions during fabrication and service. No glass or filler ceramic requiring a high-temperature sintering of the feedthrough pins is used. The feedthrough permits the feedthrough pins to be joined to the ceramic feedthrough plate at the same time that the feedthrough plate is affixed to the package structure in which it is supported, reducing the number of manufacturing steps.

In accordance with the invention, a method for preparing an electrical feedthrough includes furnishing a ceramic feedthrough plate, preferably high-density, high-purity aluminum oxide, having a feedthrough plate thickness. There is also furnished at least one metallic feedthrough pin, preferably gold-coated molybdenum or uncoated kovar, having a length greater than the feedthrough plate thickness. A pin bore is formed through the feedthrough plate for each feedthrough pin. Each pin bore has a pin bore size greater than the feedthrough pin, preferably by an amount no greater than that required to permit the penetration of a brazing metal between the pin bore and the feedthrough pin. Each pin bore may have a counterbore at one end thereof, or, instead, the pin may have a flange and the bore is not counterbored. Each feedthrough pin is inserted into its respective pin bore, and brazed into its respective pin bore utilizing a metallic braze alloy. The final step of brazing the feedthrough pins into the pin bores may be accomplished concurrently with the brazing of the entire ceramic feedthrough plate into the package structure that supports it.

No glass or ceramic material is used to fix the feedthrough pins to the ceramic feedthrough plate, as in prior approaches. This change avoids the need for a separate sealing step involving the particular thermal treatment required for glass or ceramic sealing. It also avoids the presence of the low-ductility glass or ceramic sealing material in the final feedthrough, and uses a more-ductile metallic braze instead. The feedthrough is therefore more resistant to damage during subsequent steps of the processing and also during service.

The present invention provides an advance in the art of electrical feedthroughs, by providing a robust feedthrough whose fabrication is compatible with that of the entire package structure with which it is used. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
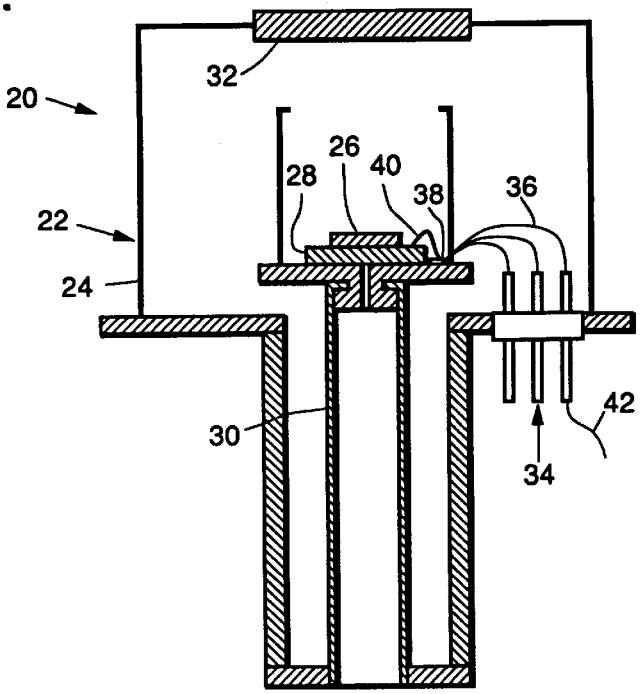
FIG. 1 is a schematic sectional view of a package structure utilizing an electrical feedthrough.

FIG. 1 depicts an apparatus 20 having a vacuum package enclosure 22 with a wall 24. Within the vacuum package enclosure 22 is a device 26, in this case an infrared sensor, that requires an electrical interconnection with electronic circuitry (not shown) external to the apparatus 20. The device 26 is mounted on a base 28, which in turn is mounted on a pedestal 30 that is attached to the base of the interior of the vacuum package enclosure 22. The pedestal 30 and thence the device 26 are cooled by a Joule-Thomson cryostat or other cooling means (not shown) to a temperature that is typically about 77K or less. The device 26 faces forwardly through a window 32 which is supported in the wall 24.

In the assembled and operating form of the apparatus 20, the contained volume within the vacuum package enclosure 22 is evacuated. The wall 24 therefore separates an evacuated space from ambient air. A hermetic seal must be maintained between the interior of the vacuum package enclosure 22 and the exterior.

The apparatus 20 includes an electrical feedthrough 34. The feedthrough 34 provides a portion of the electrical connection from the device 26 to the exterior of the apparatus 20. To connect from the feedthrough 34 to the device 26, there is a fine-wire internal lead 36 from the feedthrough 34 to a conductor trace 38 on the surface of the base 28, which in turn connects to another lead 40 that connects to the device 26. Exterior to the feedthrough 34, there is an external electrical connection, here shown to be a soldered lead 42, but which could be a permanent connector, a disconnectable connector, or any other suitable connection means.

Figure 2:
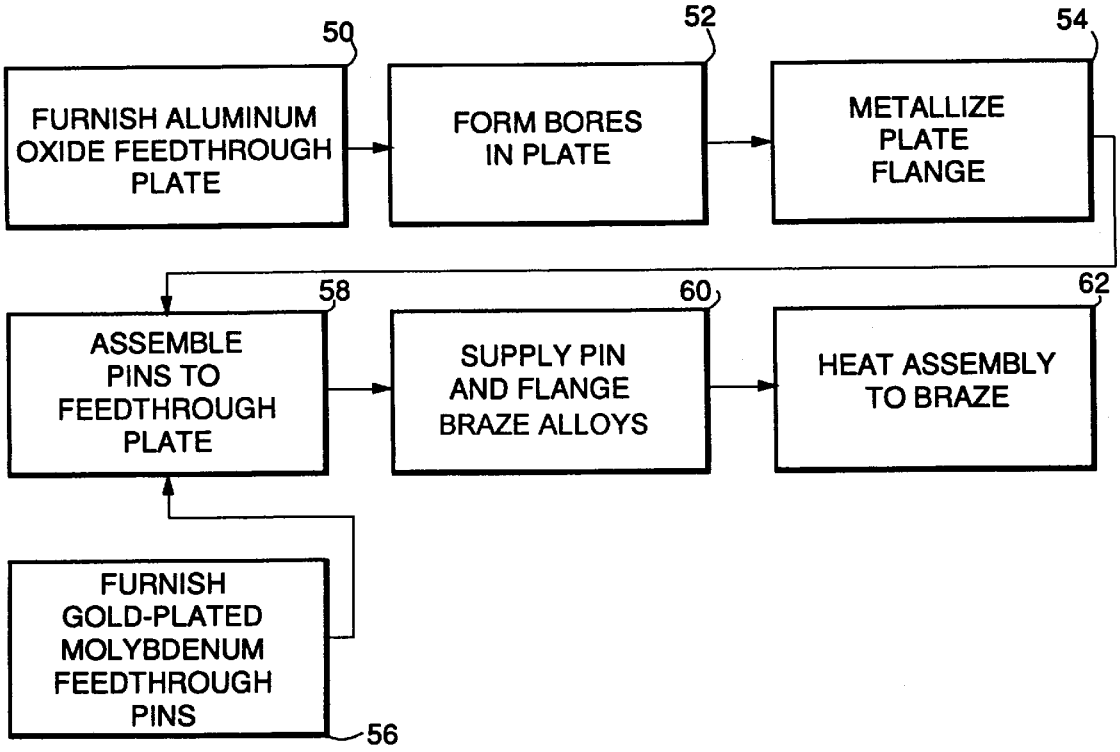
FIG. 2 is a process flow chart for the method of the invention.
Figure 3:
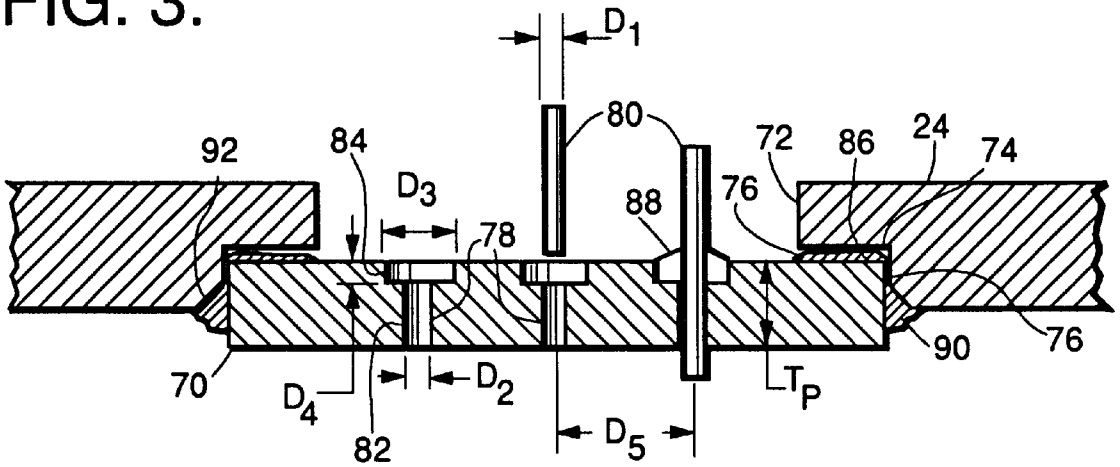
FIG. 3 is an enlarged schematic sectional view of a counterbored ceramic feedthrough plate and the feedthrough pins, in relation to the package structure during fabrication.

The preferred embodiment of the present invention is concerned with the structure and fabrication of the feedthrough 34, and also with its co-fabrication into the vacuum package enclosure 22. FIG. 2 depicts the approach for manufacturing the feedthrough and integrating it into the vacuum package enclosure. FIG. 3 is an enlarged schematic view of one embodiment of the feedthrough as it is being manufactured and attached to the wall of the vacuum package enclosure. The present invention has broader applicability that its use in the preferred apparatus 20, however, and is not so limited.

Referring to the process steps of FIG. 2 and the corresponding structures of FIG. 3, a ceramic feedthrough plate 70 is furnished, numeral 50. The ceramic feedthrough plate is preferably formed of high-density, high-purity aluminum oxide (alumina) having a purity of about 99.6 percent aluminum oxide. The ceramic feedthrough plate 70 is typically a circular flat plate, but can be of other shapes if desired. The feedthrough plate 70 has a thickness $T_p$ (FIG. 3) of at least about 0.050 inches to withstand the mechanical loads imposed upon it. The feedthrough plate 70 is sized to be received within an aperture opening 72 of the wall 24 of the vacuum package enclosure. The aperture opening is typically provided with a recess 74 which receives the feedthrough plate 70 therein. The portion of the feedthrough plate 70 that faces and registers with the wall 24 at the recess 74 is termed the flange face 76.

At least one, and preferably at least several, bores 78 are formed through the thickness of the feedthrough plate 70, numeral 52. Each bore 78 is shaped to receive a feedthrough pin 80. In the embodiment of FIG. 3, the feedthrough pins 80 are circular cylinders with a diameter $D_1$, and the bores 78 are also circular cylinders.

The bores 78 may have regions of two different diameters along their lengths. A first region 82 has a diameter $D_2$ that is larger than the feedthrough pin diameter $D_1$. $D_2$ is preferably larger than $D_2$ by an amount no greater than that required to permit the penetration of a brazing metal between the bore 78 and the feedthrough pin 80. In a typical example, the feedthrough pins 80 have a diameter of about 0.018 inches, and the first region 82 of the bores 78 have a diameter of about 0.0195 inches. The total clearance between the first region 82 of the bores 78 and their respective feedthrough pins 80 is about 0.0015 inches.

A second region 84 of the bore 78 is adjacent one of the plate surfaces, and has a diameter $D_3$ of about twice that of the first region 82. The second region 84 essentially constitutes a counterbore that is useful in subsequent brazing operations. The length of the second region 84 along the axis of the bore 78, the dimension $D_4$, is about 0.020 inches.

The bore 78 having two diametral regions 82 and 84 is preferably formed by ultrasonic machining or drilling, a well known ceramic processing operation. In a first step, a hole of size $D_2$ is formed through the plate, and in a second step a counterbore of size $D_3$ is formed to the required depth $D_4$. With this approach, the bores can be precision formed in the final, fired ceramic plate 70, so that there is substantially no subsequent dimensional change.

Where there is more than one bore present, the bores 78 are spaced apart by a center-to-center distance $D_5$ that is somewhat greater than the diameter $D_1$ of the feedthrough pins 80. The distance $D_5$ must be sufficiently great that the feedthrough plate 70 has a mechanical strength sufficient for its intended application. It has been found that, for the preferred feedthrough pins of diameter 0.018 inches, the center-to-center distance $D_5$ of the bores 78 should be at least about 0.050 inches.

Figure 4:
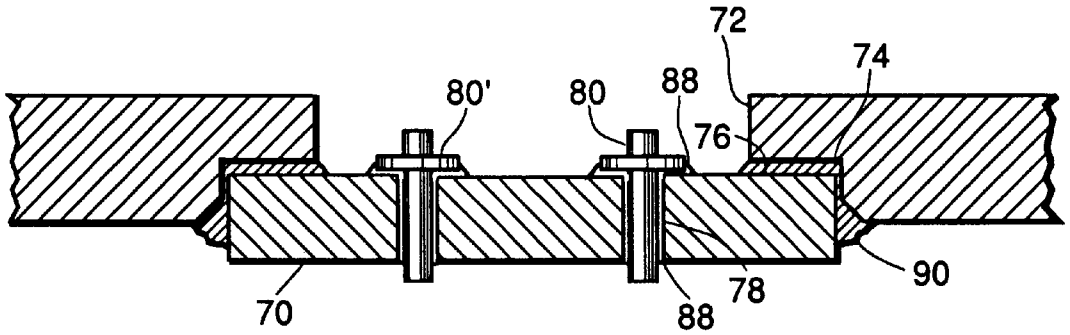
FIG. 4 is an enlarged schematic sectional view of a ceramic feedthrough plate and flanged feedthrough pins, in relation to the package structure during fabrication.

Another embodiment is shown in FIG. 4, whose structure is like that of FIG. 3 except as next described. In the embodiment of FIG. 4, the bore 78 is of a single diameter (i.e., no counterbored region 84) and each pin has a pin flange 80' extending outwardly from the body of the pin to engage the surface of the feedthrough plate 70. The pin flange 80' serves both to position the pin and provide a region of attachment in the brazing step to be described subsequently.

The feedthrough pins 80 are joined to the ceramic plate 70 in an approach that is applicable to the embodiments of FIGS. 3 or 4, or any other operable embodiment of the invention. One important advantage of the present approach is that the feedthrough pins 80 can be joined to the feedthrough plate 70 in the same processing step in which the feedthrough plate 70 is joined to the wall 24. The joining of the feedthrough plate 70 to the wall 24 can be accomplished by the same active brazing approach used to join the pins 80 to the feedthrough plate 70, which will be described in detail subsequently. Alternatively, the feedthrough plate 70 can be joined to the wall 24 by a combination of metallizing and nonactive brazing. In the latter case, the flange face 76 of the feedthrough plate 70 is metallized before further assembly, numeral 54. To metallize the flange face 76, the remainder of the feedthrough plate 70 that is not to be metallized is masked with a conventional mask. A metallic layer 86 of a metal such as molybdenum-manganese is deposited upon the flange face 76 by any suitable technique, such as painting of a powder paste onto the surface and evaporation of the carrier. The thickness of the metallic layer 86 can vary as desired, but is typically about 0.001 inch. Where the feedthrough plate is brazed to the wall by active brazing, step 54 is omitted.

The required number of feedthrough pins 80 are furnished, numeral 56. The preferred feedthrough pins 80 are cylinders about 0.018 inches in diameter for use as electrical signal feedthroughs (or may have pin flanges 80' for use in the embodiment of FIG. 4). The feedthrough pins 80 are preferably made of molybdenum with a gold plating about 0.001 inch thick thereon. Molybdenum is the preferred material for the feedthrough pin because of its low coefficient of thermal expansion, and the gold coating provides a good medium for accomplishing either connector mating or soldering of leads 36, 42. Other sizes and compositions of feedthrough pins (e.g., kovar) may be used for other applications, as for example carrying the larger currents required for operation of internal getters (not shown) within the vacuum package enclosure 22.

The feedthrough pins 80 are assembled to the feedthrough plate 70 by inserting the feedthrough pins 80 through the lengths of the bores 78, numeral 58. FIG. 3 shows the leftmost bore as having no feedthrough pin as yet inserted, the center bore as having a feedthrough pin about to be inserted, and the rightmost bore as having the feedthrough pin fully inserted through the bore.

A first braze alloy 88 for joining the feedthrough pins 80 to the feedthrough plate 70 is supplied, numeral 60. Inasmuch as the preferred approach utilizes the co-fabrication procedure of simultaneously joining the feedthrough plate 70 to the wall 24, a second braze alloy for joining the feedthrough plate 70 to the wall 24 is also provided in this same step. If the active brazing technique is used to join the feedthrough plate 70 to the wall 24, the second braze alloy may be the same as the first braze alloy. If the non-active brazing technique is used, the second braze alloy is usually different from the first braze alloy.

A quantity of the first braze alloy 88 is placed between the feedthrough pin 80 and the feedthrough plate 70 in the counterbore second region 84. A quantity of the second braze alloy 90 is placed adjacent to the space between the feedthrough plate 70 and the recess 74 in the wall 24. A bevel 92 in the recess 74 is typically provided to aid in drawing the second braze alloy 90 into this space.

The brazing is preferably accomplished by active brazing of both the pins 80 to the feedthrough plate 70, and of the feedthrough plate 70 to the wall 24. Active brazing of ceramics to metals in other contexts is well known in the art. See, for example, H. Mizuhara et al., "Joining Ceramic to Metal with Ductile Active Filler Metal," *Welding Journal*, pages 43–51 (October 1986). In general, an active braze alloy is one which contains an alloying ingredient such as titanium that chemically reacts with the contacted ceramic and possibly the oxide on the contacted metal at the brazing temperature, in order to effectuate wetting of the brazing alloy to the contacted materials.

In the present case, the first brazing alloy 88 and the second brazing alloy 90 are preferably both of a composition, in weight percent, of 92.75 percent silver, 5.0 percent copper, 1.25 percent titanium, and 1.0 percent aluminum. This preferred brazing alloy is available commercially from Wesgo Corp. under the trade name "Silver ABA". No fluxes are required.

Where the second braze alloy is a nonactive braze alloy, any composition may be used that is suitable for the particular metals being brazed. Examples of such nonactive braze alloys, with their compositions given in weight percent, include a 72 percent copper, 28 percent silver alloy (available commercially from Wesgo Corp. under the trade name "Cusil"); a 58 percent silver, 32 percent copper, 10 percent palladium alloy (available commercially from Wesgo Corp. under the trade name "Palcusil-10"); and an 81.5 percent gold, 16.5 percent copper, 2.0 percent nickel alloy (available from Wesgo Corp. under the trade name "Nicoro-80").

In the preferred case where both braze alloys are the active braze alloy Silver ABA, the assembly as described is placed into a furnace, preferably in a vacuum of less than about $10^{-5}$ Torr, and heated to a temperature sufficiently high to melt the braze alloys, numeral 62. In this case, the assembly is preferably heated at a rate of about 55° F. per minute to a temperature of about 1575° F., which is below the melting point of the braze alloys, and held at that temperature for about 20 minutes to permit thermal equilibration. Heating at the same rate is resumed to a brazing temperature of 1710° F., which is above the melting point of the braze alloys, and the assembly is held at that temperature for a period of 4 minutes to complete the braze metal infiltration. Upon melting, the braze alloys are drawn between their respective components being brazed by capillary action. During the transient liquid phase portion of the brazing process the first active braze alloy wets to both the ceramic feedthrough plate 70 and the feedthrough pin 80, forming a hermetic seal, and the second active braze alloy wets to both the feedthrough plate 70 and the wall 74, forming a hermetic seal. The assembly is thereafter radiatively cooled.

This preferred co-fabrication approach is used in conjunction with a single brazing step for joining all of the brazed components of the apparatus 20, except for the window 32 which is affixed later because the window material cannot withstand the brazing temperature. (In other cases, the apparatus 20 is formed as an upper vacuum housing and a lower vacuum housing, with the feedthrough in the lower vacuum housing. In this case, the lower vacuum housing is fabricated from its components in a single brazing operation.) This co-fabrication procedure reduces the number of processing steps, thereby reducing the cost of the apparatus. It also reduces the number of times that the various components and joints must be heated to high temperature in the joining operation, thereby improving the manufacturing yield and reliability of the final apparatus.

Brazed feedthroughs prepared in the manner described above have been prepared. The feedthroughs were tested by immersing them in a dry ice/alcohol mixture at about 150K and then warming to ambient temperature. This thermal cycling simulates the service conditions of the particular apparatus 20. The cycle was repeated 10 times. Hermeticity requirements of a flow below $10^{-10}$ standard atmosphere cubic centimeter per second helium equivalent were maintained both before and after the thermal cycling. Wire bonding, tab bonding, and soldering of leads 36 and 42 to the ends of the feedthrough pins 80 have been established. Electrical isolation of the pins 80 with a resistance of at least 1000 megohms at 100 volts DC was demonstrated.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an electrical feedthrough, comprising the steps of:

furnishing a ceramic feedthrough plate having a feedthrough plate thickness;

furnishing a vacuum package enclosure structure which receives the feedthrough plate therein;

furnishing at least one metallic feedthrough pin having a length greater than the feedthrough plate thickness;

forming a pin bore through the feedthrough plate for each feedthrough pin, each pin bore having a pin bore size greater than that of the feedthrough pin;

inserting each feedthrough pin into its respective pin bore;

brazing each feedthrough pin into its respective pin bore utilizing a metallic braze alloy; and brazing the feedthrough plate to the vacuum package enclosure structure the step of brazing the feedthrough plate to the vacuum package enclosure structure to occur concurrently with the step of brazing each feedthrough pin into its respective pin bore.

2. The method of claim 1, wherein the step of furnishing a ceramic feedthrough plate includes the step of furnishing an aluminum oxide feedthrough plate having a thickness of at least about 0.050 inches.

3. The method of claim 1, wherein the step of forming a pin bore includes the step of counterboring the pin bore.

4. The method of claim 1, wherein the step of furnishing at least one metallic feedthrough pin includes the step of furnishing at least one feedthrough pin having a pin flange extending radially therefrom.

5. The method of claim 1, wherein the step of furnishing at least one metallic feedthrough pin includes the step of furnishing a gold-plated molybdenum feedthrough pin.

6. The method of claim 1, wherein the step of furnishing at least one metallic feedthrough pin includes the step of furnishing a feedthrough pin having a diameter of about 0.018 inches.

7. The method of claim 1, wherein the feedthrough pin is cylindrical, and wherein the step of forming a pin bore includes the step of forming a cylindrical pin bore having a diameter about 0.0015 inches greater than that of the feedthrough pin.

8. The method of claim 1, wherein the step of furnishing at least one metallic feedthrough pin includes the step of furnishing at least two metallic feedthrough pins, each feedthrough pin having a diameter of about 0.018 inches, and wherein the step of forming a pin bore through the feedthrough plate for each feedthrough pin includes the step of spacing the centers of the pin bores at least about 0.050 inches apart.

9. The method of claim 1, wherein the step of brazing each feedthrough pin includes the step of furnishing an active braze alloy.

10. The method of claim 1, wherein the step of brazing the feedthrough plate to the vacuum package enclosure structure includes the step of furnishing an active braze alloy.

11. The method of claim 1, including an additional step, prior to the step of brazing the feedthrough plate to the vacuum package enclosure structure, of metallizing a portion of an external surface of the feedthrough plate, and wherein the step of brazing the feedthrough plate to a package structure includes the step of furnishing a non-active braze alloy.

12. A feedthrough prepared by the method of claim 1.

13. A method for preparing an electrical feedthrough, comprising the steps of:

furnishing a vacuum package enclosure having a wall;

furnishing a feedthrough plate having a feedthrough plate thickness;

furnishing at least one feedthrough pin having a length greater than the feedthrough plate thickness;

forming a pin bore through the feedthrough plate for each feedthrough pin, each pin bore having a pin bore diameter greater than the feedthrough pin;

inserting each feedthrough pin into its respective pin bore;

furnishing a first metallic braze alloy which is an active braze alloy;

furnishing a second metallic braze alloy;

brazing each feedthrough pin into its respective pin bore utilizing the first braze alloy; and, simultaneously with the step of brazing each feedthrough pin into its respective pin bore, brazing the feedthrough plate to the wall of the vacuum package enclosure utilizing the second braze alloy.

14. The method of claim 13, wherein the step of furnishing a second metallic braze alloy includes the step of furnishing an active braze alloy.

15. The method of claim 13, including an additional step, prior to the step of brazing the feedthrough plate, of metallizing a portion of an external surface of the feedthrough plate, and wherein the step of furnishing a second metallic braze alloy includes the step of furnishing a non-active braze alloy.

16. The method of claim 13, wherein the feedthrough pin is cylindrical, and wherein the step of forming a pin bore includes the step of forming a cylindrical pin bore having a diameter about 0.0015 inches greater than that of the feedthrough pin.

17. A feedthrough prepared by the method of claim 13.

18. An electrical feedthrough, comprising:

an aluminum oxide feedthrough plate having a feedthrough plate thickness;

a vacuum package enclosure structure sized to receive the feedthrough plate therein;

at least one feedthrough pin having a length greater than the feedthrough plate thickness;

a pin bore through the feedthrough plate for each feedthrough pin, each pin bore having a pin bore diameter greater than the feedthrough pin by an amount no greater than that required to permit the penetration of a brazing metal between the pin bore and the feedthrough pin, each pin bore further having a counterbore at one end thereof;

a metallic brazed joint between each feedthrough pin and its respective bore, there being no glass in the brazed joint; and a second metallic brazed joint between the vacuum package enclosure structure and the feedthrough plate the second metallic brazed joint being formed of an active brazing material.

* * * * *